US012616319B2

(12) United States Patent
Dell

(10) Patent No.: US 12,616,319 B2
(45) Date of Patent: May 5, 2026

(54) DIMENSIONALLY STABLE HOLLOW ARTICLE AND METHOD FOR STORING AT LEAST ONE HOSIERY ITEM

(71) Applicant: Margarita Dell, Walsrode (DE)

(72) Inventor: Margarita Dell, Walsrode (DE)

( * ) Notice: Subject to any disclaimer, the term of this patent is extended or adjusted under 35 U.S.C. 154(b) by 385 days.

(21) Appl. No.: 18/009,938

(22) PCT Filed: Jun. 9, 2021

(86) PCT No.: PCT/EP2021/065412
§ 371 (c)(1),
(2) Date: Jul. 11, 2023

(87) PCT Pub. No.: WO2021/250071
PCT Pub. Date: Dec. 16, 2021

(65) Prior Publication Data

US 2023/0270267 A1 Aug. 31, 2023

(30) Foreign Application Priority Data

Jun. 10, 2020 (EP) ..... 20179349

(51) Int. Cl.
*A47F 7/10* (2006.01)

(52) U.S. Cl.
CPC ..... *A47F 7/10* (2013.01)

(58) Field of Classification Search
CPC ..... A47F 7/10; A41B 11/00; B65D 25/02; B65D 85/18; A43B 23/081
USPC ..... 206/278
See application file for complete search history.

(56) References Cited

U.S. PATENT DOCUMENTS 1,115,320 A * 10/1914 Smith ..... A43D 3/1433 223/66
1,485,385 A * 3/1924 Gerritson ..... D06F 59/06 223/76
D105,727 S * 8/1937 Smith ..... 12/128 R
D114,990 S * 5/1939 Smith ..... 12/128 R
2,219,773 A * 10/1940 Gutermuth ..... A47F 7/10 223/75
2,588,704 A * 3/1952 Cox ..... A47F 7/10 223/75
2,610,340 A * 9/1952 Nettler ..... A43D 3/1433 12/128 R
2,667,292 A * 1/1954 Nettler ..... A47F 7/10 223/75
2,690,862 A * 10/1954 Carr ..... A47F 7/10 D6/672
2,707,566 A * 5/1955 Eaton ..... A47F 7/10 211/205

(Continued)

*Primary Examiner* — Ernesto A Grano
(74) *Attorney, Agent, or Firm* — PatentXL Law Firm

(57) ABSTRACT

The invention relates to a dimensionally stable hollow article for storing at least one hosiery item, particularly tights or a pair of stockings, comprising an inner cavity for receiving part of the stocking, a front side with respect to a longitudinal axis of the hollow article, and a rear side opposite of the front side along the longitudinal axis, and a lower side with respect to the longitudinal axis, and an upper side opposite of the lower side perpendicular to the longitudinal axis. The invention further relates to a method for storing at least one hosiery item such that the at least one hosiery item has an improved identifiability of the colour, pattern, and thickness of the hosiery items.

10 Claims, 3 Drawing Sheets

(56) References Cited

U.S. PATENT DOCUMENTS 3,137,875 A * 6/1964 Bingham, Jr. ..... A43D 3/1433 223/66
3,252,567 A * 5/1966 Baron ..... B65D 57/00 206/278
3,415,359 A * 12/1968 Vrana ..... B65D 85/18 24/17 R
3,570,728 A * 3/1971 DeWitt ..... A47F 7/10 40/538
4,010,878 A * 3/1977 Westmoreland ..... A43B 3/30 223/75
4,624,375 A * 11/1986 Strongosky ..... A47F 7/10 223/75
D294,009 S * 2/1988 Lazar ..... D9/418
D342,372 S * 12/1993 Gumbert ..... D2/979
6,390,001 B1 * 5/2002 Jones ..... D05B 97/10 112/470.15
D514,802 S * 2/2006 Nadler ..... D2/979
D651,254 S * 12/2011 Rimmer ..... D20/32
D734,019 S * 7/2015 Harris ..... D2/979
D861,798 S * 10/2019 Denby ..... D20/32
D883,649 S * 5/2020 Huang ..... D2/979
D982,304 S * 4/2023 Blakely ..... D2/979
2006/0070262 A1 * 4/2006 Shaw ..... A43B 23/087 36/77 R
2007/0289165 A1 * 12/2007 Sartor ..... A43B 23/086 36/77 R
2008/0148607 A1 * 6/2008 Spar ..... A43B 23/081 36/77 R
2008/0197158 A1 * 8/2008 Tu ..... A47F 8/00 223/66
2010/0059396 A1 * 3/2010 Lindars ..... B65D 73/0071 206/299
2013/0255111 A1 * 10/2013 Sakurai ..... A43B 23/081 36/77 R
2024/0373986 A1 * 11/2024 Besl ..... A43B 17/16

* cited by examiner

DIMENSIONALLY STABLE HOLLOW ARTICLE AND METHOD FOR STORING AT LEAST ONE HOSIERY ITEM

BACKGROUND OF THE INVENTION

Field of the Invention

The invention relates to a dimensionally stable hollow article for storing at least one hosiery item, particularly tights or a pair of stockings, comprising an inner cavity for receiving part of the stocking, a front side with respect to a longitudinal axis of the hollow article, and a rear side opposite of the front side along the longitudinal axis, and a lower side with respect to the longitudinal axis, and an upper side opposite of the lower side perpendicular to the longitudinal axis.

The invention further relates to a method for storing a hosiery item using the hollow article.

Description of the Related Art

Hosiery items, particularly stockings and tights, are usually stored in drawers in a rolled-up or balled-up manner so that the colour, pattern, and thickness of the stockings are hard to identify.

The document DE 7212081 U discloses a packing container for hosiery items, particularly tights. The packing container is formed by a substantially cylindrical container which is closed in a line-shape on one end and can be covered by a cap on its other end. In the container, tights can be stored with low space requirements in a twisted state.

SUMMARY OF THE INVENTION

It is the object of the invention to provide a device and a method for the space-saving storage of hosiery items providing for an improved identifiability of the colour, pattern, and thickness of the hosiery items.

The subject matter of the present invention provides a hollow article according to claim 1 which solves the technical object. The object is likewise solved by a claimed method. Advantageous embodiments will become apparent from the dependent claims.

The hollow article according to the invention is designed for storing at least one hosiery item, particularly tights or of a pair of stockings, and implemented with an inner cavity for receiving part of the hosiery item, for example a lower leg portion and a foot portion of a leg section as well as a hip section and another leg section of the tights.

Within the meaning of the invention, those parts of the hosiery item which adjoin a leg or on a hip of a wearer of the hosiery item when the hosiery item is worn are referred to as a leg section and hip section of the hosiery item. Correspondingly, those portions of the leg section adjoining a thigh, knee, lower leg, or foot when the hosiery item is worn are referred to as the thigh portion, knee portion, lower leg portion, or foot portion.

The hollow article is implemented with a front side with respect to a longitudinal axis of the hollow article, and a rear side opposite of the front side along the longitudinal axis, and with a lower side with respect to the longitudinal axis, and an upper side opposite of the lower side perpendicular to the longitudinal axis.

The hollow article is dimensionally stable, i.e., its shape is substantially invariable when used and stored as intended. In particular, its shape may be invariable except for minor elastic deformations. A deformation is deemed minor when a dimension of the hollow article is changed by less than 25%, particularly by less than 15% thereby.

The hollow article is designed to be inserted, front side first, along the longitudinal axis, into a thigh portion of the hosiery item, the upper side preferably being convexly curved about the longitudinal axis at least in portions, particularly over an entire length of the hollow article along the longitudinal axis. The curvature of the upper side results in the advantage that a front side of the thigh portion can be stretched over the upper side of the hollow article like on a human thigh so that a colour, thickness, and patterning of the front side can be seen as they appear on the thigh in a simple manner.

The hollow article preferably tapers along the longitudinal axis from the rear side to the front side at least in a front section of the hollow article adjacent to the front side, preferably over an entire length of the hollow article along the longitudinal axis. With a, for example, conical narrowing, it is easier to insert the hollow article into the thigh portion without damaging it. In addition, the tapered shape of the hollow article corresponds to the shape of a human thigh so that the visual impression of the thigh portion stretched over the hollow article is particularly close to the visual impression of the thigh portion on a human thigh.

The lower side and/or the rear side comprise(s) at least one planar standing surface for stably mounting the hollow article on a horizontal base. A stable installation is particularly achieved by a projection of the centre of gravity of the hollow article, particularly in a state of the hollow article loaded with the hosiery item, being located along a surface normal of the standing surface within a contour of the standing surface.

With the aid of the standing surface on the lower side, the hollow article can advantageously be stably positioned so that a front side of the thigh portion of the hosiery item stretched over the upper side of the hollow article can be clearly seen from above. This is advantageous, for example, when the hollow article including the hosiery item is placed in a drawer to store the hosiery item at low space requirements so that the colour, pattern, and thickness of the hosiery item are identifiable at one glance.

With the aid of the standing surface on the rear side, the hollow article can advantageously be stably positioned so that a front side of the thigh portion of the hosiery item stretched over the upper side of the hollow article is clearly visible from the side. This is advantageous, for example, when the hosiery item including the hollow article is presented in a shop floor to present the hosiery item at low space requirements so that the colour, pattern, and thickness of the hosiery item are clearly visible.

Preferably, both the rear side and the lower side of the hollow article respectively comprise a planar standing surface so that the hollow article is multifunctional.

A standing surface within the meaning of the invention may be closed or have one or a plurality of openings.

Preferably, the rear side has at least one receiving opening for receiving part of another hollow article according to the invention which is oriented in the same way as the hollow article in the cavity of the hollow article.

Owing to the receiving opening, the other hollow article can be partly inserted into the cavity of the hollow article along the longitudinal axis with its front side first so that the hollow article and the other hollow article, particularly including the hosiery items carried by them, can be stored in a particularly space-efficient manner.

For enabling the easiest possible insertion of the other hollow article into the hollow article and for saving material, the receiving opening preferably occupies the entire rear side of the hollow article except for an edge area, a width of the edge area preferably corresponding to a wall thickness of the hollow article. The edge area may particularly constitute the standing surface of the rear side.

Due to the fact that only part of the other hollow article, for example 30% to 90%, particularly 50% to 80%, of its length along the longitudinal axis, is received in the hollow article, advantageously, part of the upper side of the other hollow article will remain visible so that the colour, pattern, and thickness of the hosiery items carried by the two hollow articles will be visible even in the slid-together state of the two hollow articles.

The front side of the hollow article is preferably, at least in portions, particularly completely, convexly curved about a transverse axis oriented transverse to the longitudinal axis and along the lower side, and/or about a vertical axis perpendicular to the longitudinal axis and to the transverse axis. The convex curvature of the front side has the advantageous effect that the front side acts as a stopper when the hollow article is inserted into the thigh portion up to a predetermined depth, for example, up to a knee portion of the hosiery item, without there being the risk of damaging the hosiery item in the process.

The lower side of the hollow article preferably comprises at least one receiving opening for receiving at least part of another hollow article according to the invention oriented in the same way as the hollow article in the cavity of the hollow article.

Through the receiving opening, the other hollow article can be partly inserted into the cavity of the hollow article perpendicular to the longitudinal axis with its upper side first so that the hollow article and the other hollow article, particularly including the hosiery items carried by them, can be stored in a particularly space-efficient manner.

For enabling the easiest possible insertion of the other hollow article into the hollow article and for saving material, the receiving opening preferably receives the entire lower side of the hollow article up to an edge area, a width of the edge area preferably corresponding to a wall thickness of the hollow article. The edge area may particularly constitute the standing surface the lower side.

At least the upper side of the hollow article is preferably smooth so that the hosiery item stretched over the upper side is not damaged. Preferably, the front side, the rear side, and/or the lower side is or are also smooth. For example, a surface having a mean roughness value of 0 μm to 10 μm, particularly of 0 μm to 1 μm is deemed smooth within the meaning of the invention.

The corners and/or edges of the hollow article, particularly on the front side of the hollow article, are preferably rounded to prevent the hollow article from damaging the hosiery item.

The hollow article is preferably elastically deformable during the insertion into the thigh portion so that the thigh portion is stretched by the inserted hollow article. The elastic deformability advantageously ensures that the hollow article for storing hosiery items can be used in different sizes, the thigh portion of the hosiery item being stretched over the upper side of the hollow article so that, in any case, the colour, pattern, and thickness of the hosiery item are clearly visible without the hosiery item or the hollow article being damaged in the process.

For example, the elastic deformability may be achieved by the hollow article comprising, particularly being made of at least one elastically deformable material. For example, the material may be a plastic material, particularly a recycled plastic material, particularly a polyethylene.

Preferably, at least the upper side of the hollow article is illuminable at least in portions, particularly over the entire surface. When the thigh portion is stretched over an illuminated upper side the pattern and thickness of the hosiery item are particularly clear to see against the backlight.

The illuminable upper side may be self-luminous and comprise, for example, a phosphorescent layer, an electroluminescence film and/or an OLED film. The illuminable upper side may be transparent or translucent and designed for coupling light from a light source, for example, from at least one LED. The light source may be integrated in the hollow article or disposed outside of the hollow article.

Preferably, at least the upper side of the hollow article has, at least in portions, particularly over the entire surface, a high colour contrast to typical hosiery colours, and is preferably white. Owing to the high colour contrast, the colour, pattern, and thickness of the hosiery item are particularly clear to see. Alternatively, the upper side could also be designed in a skin colour so that the thigh portion on the upper side produces a similar visual impression as on a human thigh.

The upper side of the hollow article preferably comprises a recess for receiving at least part of a front thumb section, preferably a thumb nail of a user of the hollow article when inserting the hollow article into the thigh portion of the hosiery item. By receiving the thumb nail, the recess advantageously prevents the thumb nail from damaging the hosiery item.

The invention relates to a method for storing at least one hosiery item, particularly tights or of a pair of stockings, using a hollow article according to the invention.

The method comprises at least the following steps, particularly in the indicated order: a) inserting the hollow article into a thigh portion of a leg section of the hosiery item along the longitudinal axis of the hollow article with the front side of the hollow article first, b) stowing a hip section and another leg section of the hosiery item, particularly implemented as tights, or stowing another hosiery item, particularly implemented as a stocking, particularly through the receiving opening of the rear side of the hollow article, in the cavity of the hollow article; c) stretching a lower leg portion of the leg section over the lower side of the hollow article, particularly the lower side of the hollow article closed by the thigh portion of the leg section, and d) inserting a foot portion of the leg section into the cavity of the hollow article through the receiving opening of the rear side of the hollow article.

With the method, it is achieved that the hosiery item is securely held on the hollow article in a space-effective manner, the thigh portion of the hosiery item being stretched over the upper side of the hollow article so that the colour, pattern and thickness of the hosiery item are clearly visible there.

Depending on the size ratio between the hollow article and the hosiery item, part of the foot portion, the entire foot portion or the entire foot portion and part of the lower leg portion can be inserted into the cavity of the hollow article.

The insertion of the hollow article into the thigh portion is preferably performed so that, at the end of the insertion, the upper side of the hollow article adjoins a front side of the thigh portion at least in portions, particularly over the entire surface. When the upper side of the hollow article adjoins the front side of the thigh portion the colour, pattern, and thickness of this fashion-wise particularly relevant section of the hosiery item are clearly shown.

The insertion of the hollow article into the thigh portion is preferably performed so that, at the end of the insertion, the front side of the hollow article, at least in portions, abuts on a knee portion of the leg section. In this implementation of the method, the front side of the hollow article acts as a stopper and ensures that the hollow article is inserted into the thigh portion up to a depth predefined for an optimum storage of the hosiery item in this way.

The insertion of the foot portion into the cavity preferably comprises a seizure of the foot portion in the cavity, particularly with the aid of the sections or parts of the hosiery item already contained in the cavity. The seizure advantageously ensures that the hosiery item is securely held on the hollow article in a state in which it is stretched over the hollow article.

EXAMPLES

The hollow article according to the invention may be used as a tights organiser for storing, stowing, or sorting nylon tights, suspenders, or other similar articles comprising similar materials. The hollow article facilitates the organization of the tights or the suspenders according to the colour and pattern and serves the faster identification of the thickness usually indicated in denier (den).

For the optimum utilisation of a storage space, the hollow articles can be pushed into each other without the tights being damaged.

Embodiments of the hollow articles can be used lying on their lower side, e.g., in a drawer, but also standing on their rear side in the wardrobe. The standing use is a particularly space-efficient possibility for a tights specialist retailer to present as many tights as possible to customers in the smallest of spaces. Owing to its attractive and easily understandable shape, the hollow article can be excellently used for presenting the articles in exhibitions or in showrooms.

Owing to a reproduction of the shape of a leg including an anatomically similar knee rounding, embodiments of the hollow article enable a user to hold a plurality of tights held by hollow articles according to the invention to her leg at the same time to select the colour, the pattern or the thickness matching her outfit.

Embodiments of the hollow article may have the shape of a cylinder, of a cylinder divided through a plane, of a semi-cylinder, of a cylinder having a rounded tip, or of a thigh including a knee projection.

The method according to the invention particularly comprises a specific folding technique for tights and suspenders which enables a conserving storage of the delicate nylon articles.

In one embodiment of the method the hollow article is inserted into one leg of the tights up to the onset of the knee of the tights with the front side first, the upper side upwards, and the lower side downwards. Then, the entire upper part (the hip section) of the tights and the other leg of the tights are carefully inserted into the cavity of the hollow article provided for this purpose. Finally, the remaining portion (the lower leg and foot portion) of the leg of the tights in which the hollow article is located is smoothly and tightly passed across the lower side up to the receiving opening of the rear side of the hollow article, and also stowed in the cavity of the hollow article. In this way, preferably, some space for partly inserting another hollow article remains in the cavity.

Preferably, when the hollow article is stored in a lying state, e.g. in a drawer, the upper side is directed upwards, and the lower side downwards. In case of a standing storage of the hollow article, e.g., in a sales room, the upper side is preferably directed towards customers, and the front side upwards. The cavity as well as the rear side and the lower side of the hollow article are preferably not visible to a user or customer in both cases.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

FIG. 1

Figure 1:
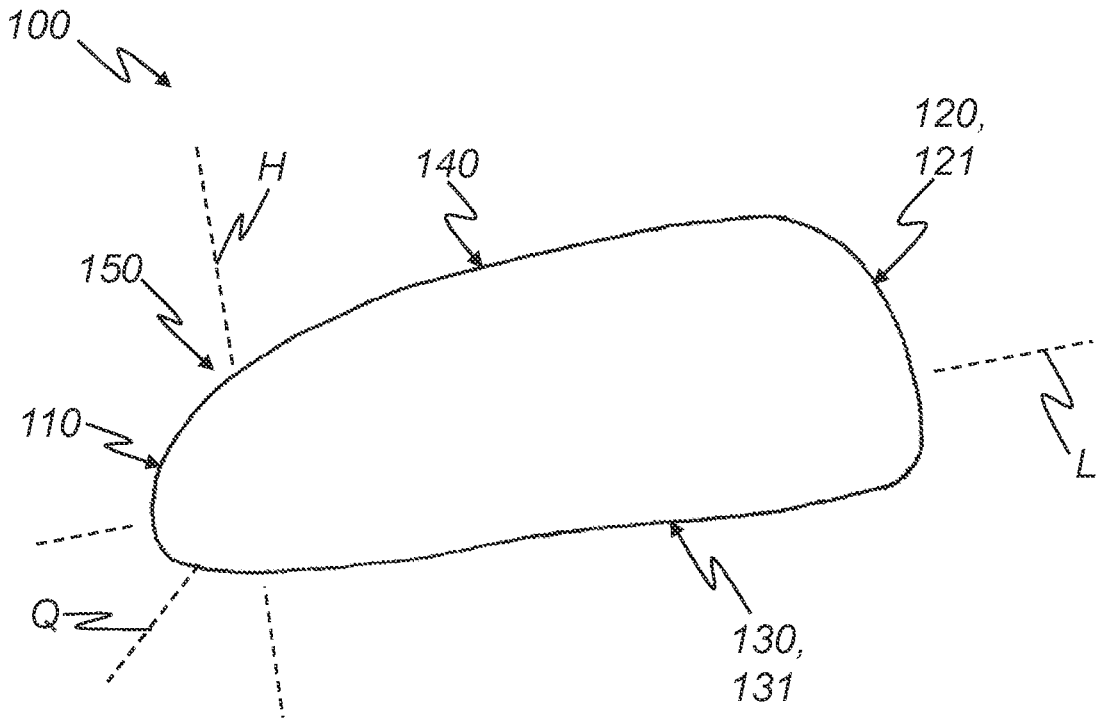
FIG. 1 shows a schematic perspective view of a hollow article according to the invention.

FIG. 1 shows a schematic perspective view obliquely from the front of a hollow article 100 according to the invention comprising an inner cavity (not visible in FIG. 1) for receiving part of a hosiery item, a front side 110 with respect to a longitudinal axis L of the hollow article 100, and a rear side 120 opposite of the front side 110 along the longitudinal axis L, and a lower side 130 with respect to the longitudinal axis L, and an upper side 140 opposite of the lower side 130 perpendicular to the longitudinal axis L.

The upper side 140 is convexly curved about the longitudinal axis L, the hollow article 100 being tapered along the longitudinal axis L from the rear side 120 to the front side 110 at least in a front section 150 of the hollow article 100 adjacent to the front side 110.

The lower side 130, and preferably also the rear side 120, comprise a planar standing surface 131 for stably mounting the hollow article 100 on a horizontal base.

The rear side 120, and preferably also the lower side 130, comprise a receiving opening 121 for receiving part of another hollow article according to the invention oriented in the same way as the hollow article 100 in the cavity of the hollow article 100. Preferably, the receiving opening 121 occupies the entire rear side 120 or lower side 130 except for an edge area, a width of the edge area preferably corresponding to a wall thickness of the hollow article 100. The edge area may particularly form the standing surface 131 of the rear side 120 or the lower side 130.

The front side (110) is preferably convexly curved about a vertical axis (H) oriented transverse to the longitudinal axis (L) and transverse to the lower side (130), and about a vertical axis (H) perpendicular to the longitudinal axis (L) and to the transverse axis (Q).

FIG. 2

Figure 2:
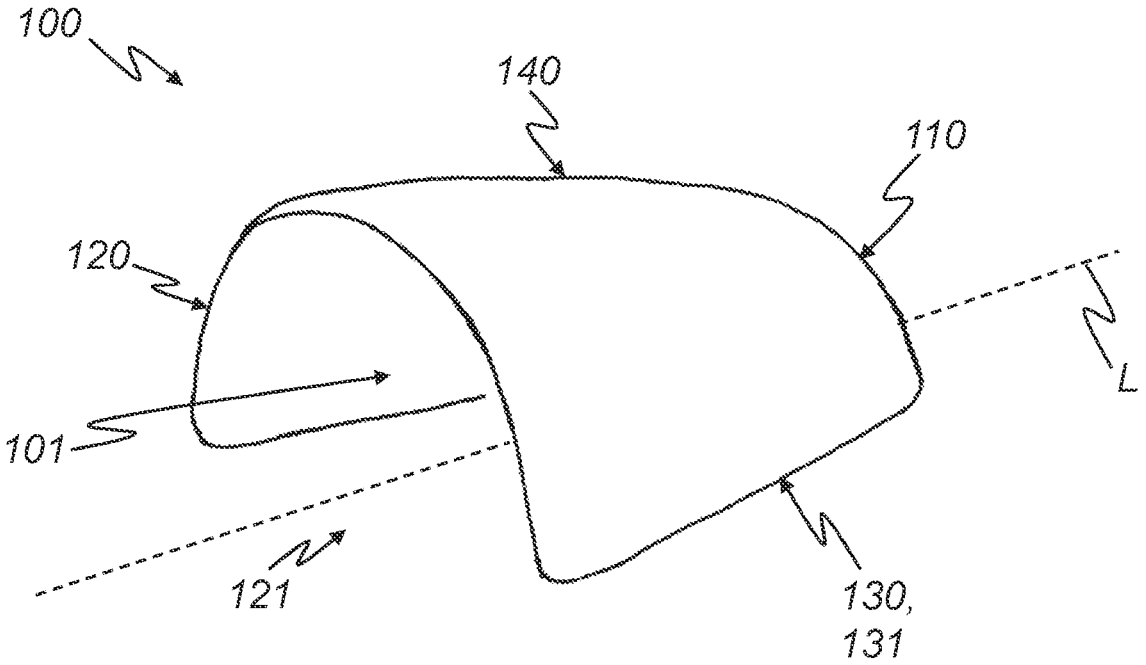
FIG. 2 shows another schematic perspective view of a hollow article according to the invention.

FIG. 2 shows another schematic perspective view of a hollow article 100 according to the invention, particularly of the hollow article of FIG. 1, obliquely from behind.

In this illustration, particularly the rear side 120 of the hollow article 100 with its receiving opening 121 and the inner cavity 101 of the hollow article 100 can be clearly seen.

FIG. 3

Figure 3:
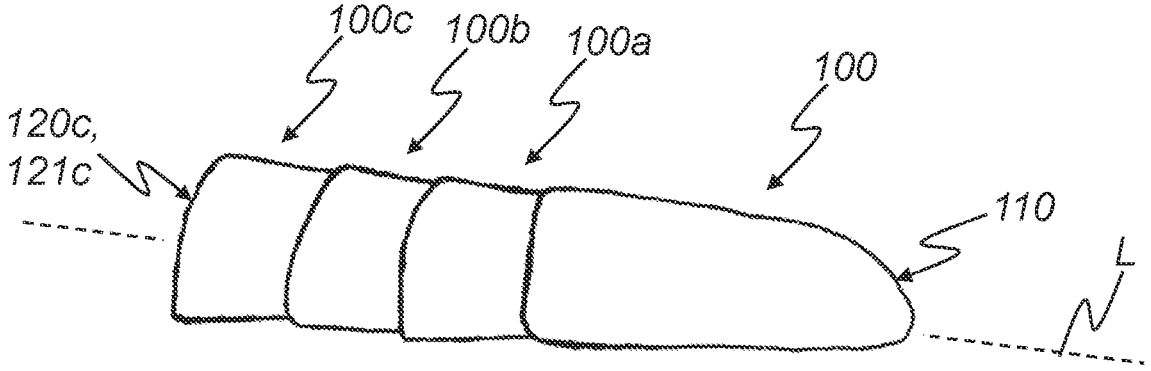
FIG. 3 shows a schematic perspective view of a plurality of hollow articles according to the invention inserted into each other.

FIG. 3 shows a schematic perspective view of a plurality of, for example four, hollow articles 100, 100*a*, 100*b*, 100*c* according to the invention inserted into each other.

Here, in three of the hollow articles 100, 100*a*, 100*b*, a further hollow article 100*a*, 100*b*, 100*c* oriented in the same way is partly inserted, with the respective front side 110 first, through the respective receiving opening 121 of the rear side 120, in the inner cavity of the respective hollow article 100, 100*a*, 100*b* along the longitudinal axis L, respectively.

FIG. 4

Figure 4:
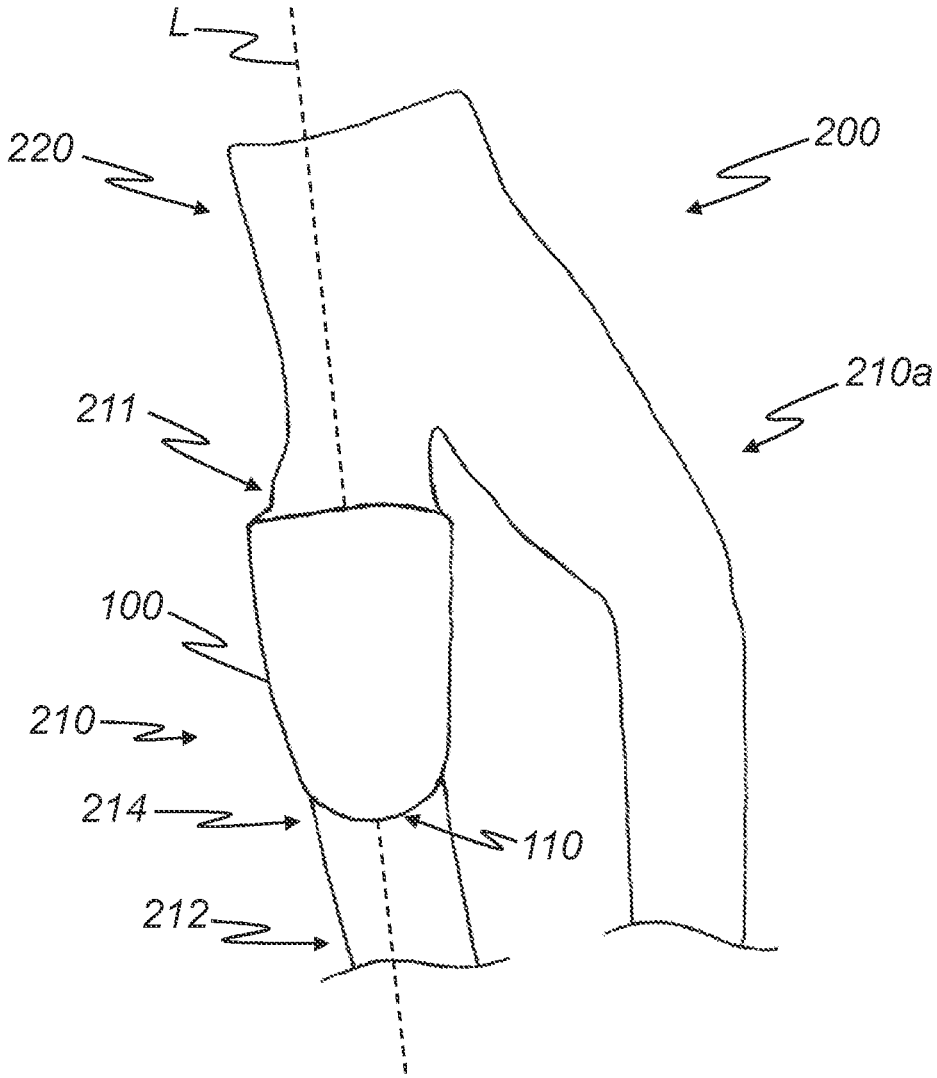
FIG. 4 schematically shows a first step of a method according to the invention.

FIG. 4 schematically shows a first step of a method according to the invention for storing a hosiery item 200, particularly tights, using a hollow article 100 according to the invention.

The illustrated step comprises an insertion of the hollow article 100 along the longitudinal axis L of the hollow article 100 with the front side 110 of the hollow article 100 first into a thigh portion 211 of a leg section 210 of the hosiery item 200.

The insertion of the hollow article 100 into the thigh portion 211 is preferably performed so that, in the end of the insertion, the upper side 140 of the hollow article 100 abuts on a front side of the thigh portion 211 and/or the front side 110 of the hollow article 100 abuts on a knee portion 214 of the leg section 210.

The leg section 210 of the hosiery item 200 further comprises a lower leg portion 212 and a foot portion (not illustrated). Furthermore, the hosiery item 200 comprises a hip section 220 and another leg section 210*a*.

FIG. 5

Figure 5:
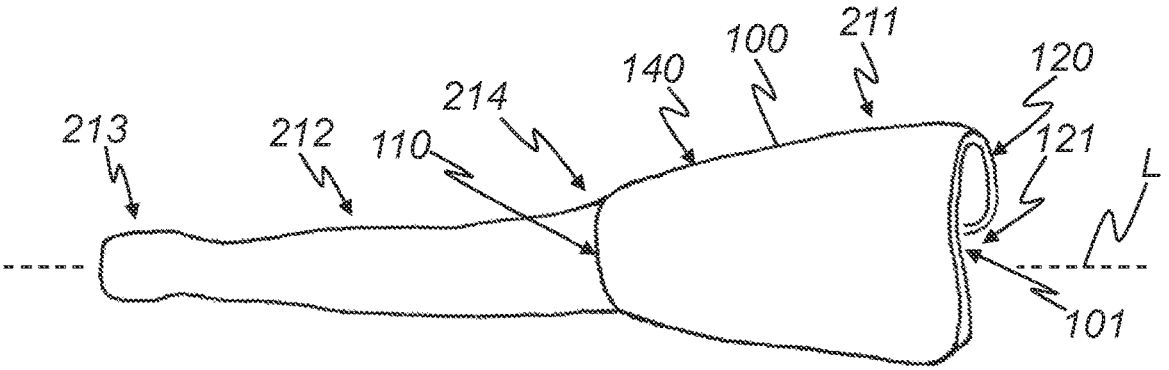
FIG. 5 schematically shows a second step of a method according to the invention.

FIG. 5 schematically shows a second step of a method according to the invention, particularly after the first step shown in FIG. 4.

The illustrated step comprises stowing the hip section 220 and the other leg section 210*a* of the hosiery item 200, particularly through the receiving opening 121 of the rear side 121 of the hollow article 100, in the cavity 101 of the hollow article 100. Here, particularly the thigh portion 211 of the leg section 210 of the hosiery item 200 may be stretched over the upper side 140 of the hollow article 100.

FIG. 6

Figure 6:
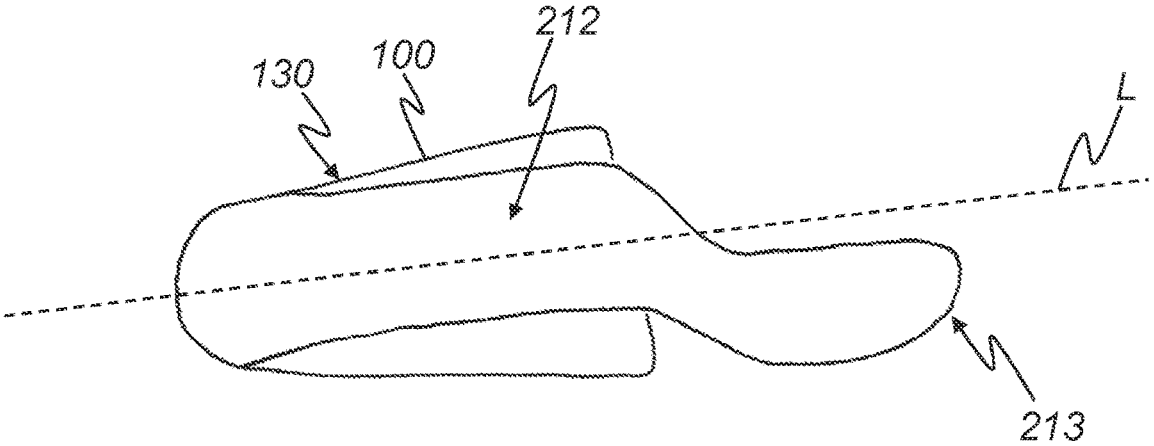
FIG. 6 schematically shows a third step of a method according to the invention.

FIG. 6 schematically shows a third step of a method according to the invention, particularly after the second step shown in FIG. 5.

The illustrated step comprises stretching the lower leg portion 212 of the leg section 210 over the lower side 130 of the hollow article 100 closed by the thigh portion 211 of the leg section 210 whereby particularly the thigh portion 211 of the leg section 210 can be further stretched over the upper side 140 of the hollow article 100.

FIG. 7

Figure 7:
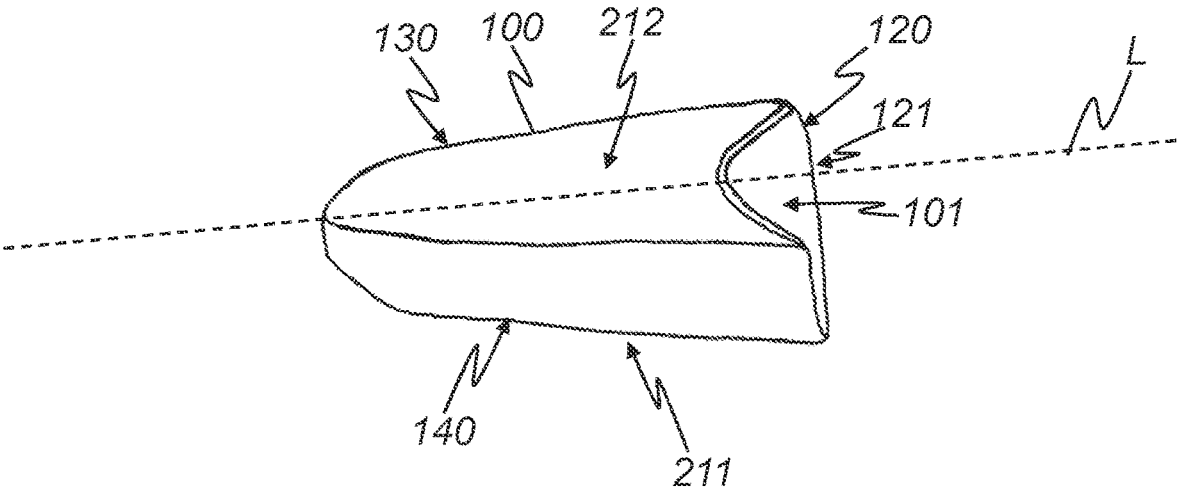
FIG. 7 schematically shows a fourth step of a method according to the invention.

FIG. 7 schematically shows a fourth step of a method according to the invention, particularly after the third step shown in FIG. 6.

The illustrated step comprises inserting the foot portion 213 of the leg section 210 through the receiving opening 121 of the rear side 120 of the hollow article 100 into the cavity 101 of the hollow article 100.

The insertion of the foot portion 213 into the cavity 101 preferably comprises seizing the foot portion 213 in the cavity 101, particularly with the aid of the parts 220, 210*a* of the hosiery item 200 already contained in the cavity 101.

LIST OF NUMERALS

| | |
|---|---|
| 100 | Hollow article |
| 101 | Cavity |
| 110 | Front side |
| 120 | Rear side |
| 121 | Receiving opening |
| 130 | Lower side |
| 131 | Standing surface |
| 140 | Upper side |
| 150 | Front section |
| 200 | Hosiery item |
| 210 | Leg section |
| 211 | Thigh portion |
| 212 | Lower leg portion |
| 213 | Foot portion |
| 214 | Knee portion |
| 220 | Hip portion |
| H | Vertical axis |
| L | Longitudinal axis |
| Q | Transverse axis |

Since many modifications, variations and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A method for storing at least one hosiery item using a dimensionally stable hollow article, wherein the dimensionally stable hollow articles has an inner cavity for receiving part of the hosiery item, a front side with respect to a longitudinal axis of the hollow article, and a rear side opposite of the front side along the longitudinal axis, and a lower side with respect to the longitudinal axis, and an upper side opposite of the lower side perpendicular to the longitudinal axis, wherein the hollow article is designed to be inserted, front side first, along the longitudinal axis, into a thigh portion of the hosiery item, wherein the upper side is convexly curved about the longitudinal axis at least in sections, wherein the hollow article tapers along the longitudinal axis from the rear side to the front side at least in a front section of the hollow article adjacent to the front side, wherein at least the rear side comprises at least one receiving opening at least for receiving part of another hollow article, which is oriented in the same way as the hollow article, in the cavity of the hollow article, wherein the corners and/or the edges of the hollow article are rounded, wherein the lower side and the rear side respectively comprise at least one planar standing surface for stably mounting the hollow article on a horizontal base, the method comprising:

inserting the hollow article, with the front side of the hollow article first, along the longitudinal axis of the hollow article, into a thigh portion of a leg section of the hosiery item, stowing a hip section and another leg section of the hosiery item or stowing another hosiery item in the cavity of the hollow article, stretching a lower leg portion of the leg section over the lower side of the hollow article, and inserting a foot portion of the leg section into the cavity of the hollow article through the receiving opening of the rear side of the hollow article.

2. The method according to claim 1, wherein the front side is, at least in portions, convexly curved about a transverse axis oriented transverse to the longitudinal axis and along the lower side and/or about a vertical axis perpendicular to the longitudinal axis and to the transverse axis.

3. The method according to claim 1, wherein the lower side comprises at least one receiving opening for receiving at least part of another hollow article oriented in the same way as the hollow article in the cavity of the hollow article.

4. The method according to claim 1, wherein at least the upper side is smooth.

5. The method according to claim 1, wherein the hollow article is elastically deformable during the insertion into the thigh portion so that the thigh portion is stretched by the inserted hollow article.

6. The method according to claim 1, wherein at least the upper side is illuminable at least in portions.

7. The method according to claim 1, wherein at least the upper side, at least in portions, has a high color contrast to typical hosiery colors.

8. The method according to claim 1, wherein the insertion of the hollow article into the thigh portion is performed so that, in the end of the insertion, the upper side of the hollow article, at least in portions, abuts on a front side of the thigh portion, and/or the front side of the hollow article, at least in portions, abuts on a knee portion of the leg section.

9. The method according to claim 1, wherein the insertion of the foot portion into the cavity comprises seizing the foot portion in the cavity.

10. The method according to claim 1, wherein the insertion of the foot portion into the cavity comprises seizing the foot portion in the cavity.

* * * * *